US008607883B2

(12) United States Patent
Sevre

(10) Patent No.: US 8,607,883 B2
(45) Date of Patent: Dec. 17, 2013

(54) SWELLABLE PACKER HAVING THERMAL COMPENSATION

(75) Inventor: Alf Kolbjørn Sevre, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 401 days.

(21) Appl. No.: 12/951,246

(22) Filed: Nov. 22, 2010

(65) Prior Publication Data

US 2012/0125640 A1 May 24, 2012

(51) Int. Cl.
*E21B 33/12* (2006.01)

(52) U.S. Cl.
USPC ..... 166/387; 166/192; 166/195; 166/196

(58) Field of Classification Search
USPC ..... 166/386, 387, 192, 195, 196
See application file for complete search history.

(56) References Cited

U.S. PATENT DOCUMENTS

| | | | | |
|---|---|---|---|---|
| 3,053,321 | A * | 9/1962 | Ortloff | 277/336 |
| 4,424,865 | A * | 1/1984 | Payton, Jr. | 166/302 |
| 4,588,029 | A | 5/1986 | Blizzard | |
| 4,655,292 | A * | 4/1987 | Halbardier | 166/387 |
| 5,433,269 | A | 7/1995 | Hendrickson | |
| 6,152,224 | A * | 11/2000 | French | 166/250.08 |
| 6,213,217 | B1 * | 4/2001 | Wilson et al. | 166/387 |
| 6,223,820 | B1 * | 5/2001 | Carisella | 166/187 |
| 6,289,994 | B1 * | 9/2001 | Willauer | 166/387 |
| 7,298,068 | B2 | 11/2007 | D'Almeida et al. | |
| 7,569,974 | B2 | 8/2009 | D'Almeida et al. | |
| 7,743,831 | B2 * | 6/2010 | Bunnell et al. | 166/302 |
| 7,762,322 | B2 | 7/2010 | Andersen et al. | |
| 2003/0196820 | A1 | 10/2003 | Patel | |
| 2005/0072579 | A1 * | 4/2005 | Gambier | 166/387 |
| 2006/0279177 | A1 | 12/2006 | D'Almeida et al. | |
| 2009/0038802 | A1 * | 2/2009 | Lucas | 166/299 |
| 2009/0065192 | A1 * | 3/2009 | Lucas | 166/119 |
| 2009/0139710 | A1 * | 6/2009 | Robisson et al. | 166/208 |
| 2009/0205833 | A1 * | 8/2009 | Bunnell et al. | 166/373 |
| 2009/0250228 | A1 * | 10/2009 | Loretz et al. | 166/387 |
| 2009/0283279 | A1 * | 11/2009 | Patel et al. | 166/382 |
| 2010/0018694 | A1 * | 1/2010 | Kunz | 166/179 |
| 2010/0243269 | A1 | 9/2010 | Solhaug et al. | |
| 2010/0326671 | A1 * | 12/2010 | Buytaert et al. | 166/378 |
| 2011/0259611 | A1 * | 10/2011 | Erkol et al. | 166/387 |
| 2012/0012343 | A1 * | 1/2012 | Wilkin et al. | 166/387 |
| 2012/0125640 | A1 * | 5/2012 | Sevre | 166/387 |
| 2012/0217025 | A1 * | 8/2012 | Shkurti et al. | 166/387 |
| 2013/0087334 | A1 * | 4/2013 | Buytaert et al. | 166/288 |

OTHER PUBLICATIONS

International Search Report with Written Opinion issued May 18, 2012 for PCT Patent Application No. PCT/US11/060291, 9 pages.

(Continued)

*Primary Examiner* — Jennifer H Gay
(74) *Attorney, Agent, or Firm* — Smith IP Services, P.C.

(57) ABSTRACT

A swellable packer for use in a subterranean well can include a seal element with a swellable material which contracts in response to temperature decrease, and a temperature compensator which applies increased force to the seal element in response to temperature decrease. A method of compensating for thermal contraction of a swellable material in a subterranean well can include a temperature of the swellable material increasing in response to installing the swellable material in the well, and a temperature compensator applying an increased force in response to a temperature decrease occurring after the temperature increasing step. A well tool for use in a subterranean well can include a swellable material and a temperature compensator which applies an increased force when the swellable material contracts.

15 Claims, 7 Drawing Sheets

(56) References Cited

OTHER PUBLICATIONS

Halliburton; "Swellpacker® Cable System", H04995, dated Aug. 2008, 2 pages.
Halliburton; "Swellpacker® Isolation System", H04810, dated Aug. 2008, 2 pages.
Halliburton; "Swellpacker® Lite Isolation System", H05081, dated Aug. 2008, 2 pages.
Halliburton; "Swellpacker® OBM System", H04992, dated Aug. 2008, 2 pages.
Halliburton; "Swellpacker® Side-Pocket System", H06830, dated Feb. 2010, 2 pages.
Halliburton; "Swellpacker® Stim Isolation System", H06137, dated Aug. 2008, 2 pages.

* cited by examiner

SWELLABLE PACKER HAVING THERMAL COMPENSATION

BACKGROUND

This disclosure relates generally to equipment utilized and operations performed in conjunction with a subterranean well and, in an example described below, more particularly provides a swellable packer having thermal compensation.

A swellable packer is typically used to seal off an annulus in a wellbore environment. Such packers include swellable material which swells when contacted with a particular fluid in a well.

Unfortunately, the swellable material and/or any additional sealing material included in a seal element of a packer can contract when its temperature decreases significantly. For example, in stimulation operations (such as fracturing, acidizing, etc.) or completion operations (such as gravel packing, etc.), relatively low temperature fluid is flowed through the packer, thereby causing the seal element to contract, and lessening the ability of the seal element to seal off the annulus.

Therefore, it will be appreciated that it would be desirable to provide for thermal compensation in swellable packers. Such thermal compensation could be useful in other applications, as well.

SUMMARY

In the disclosure below, a temperature compensator is provided which brings improvements to the art. One example is described below in which a decrease in volume of a swellable material is compensated for by the temperature compensator. Another example is described below in which a force output by the temperature compensator increases in response to a temperature decrease.

In one aspect, this disclosure provides to the art a swellable packer for use in a subterranean well. The packer can include a seal element with a swellable material which contracts in response to temperature decrease, and a temperature compensator which applies increased force to the seal element in response to temperature decrease.

In another aspect, a method of compensating for thermal contraction of a swellable material in a subterranean well is provided by the disclosure. The method can include a temperature of the swellable material increasing in response to installing the swellable material in the well, and a temperature compensator applying an increased force in response to a temperature decrease occurring after the temperature increasing step.

In yet another aspect, a well tool (not necessarily a packer) for use in a subterranean well can include a swellable material and a temperature compensator which applies an increased force when the swellable material contracts.

These and other features, advantages and benefits will become apparent to one of ordinary skill in the art upon careful consideration of the detailed description of representative examples below and the accompanying drawings, in which similar elements are indicated in the various figures using the same reference numbers.

DETAILED DESCRIPTION

Figure 1:
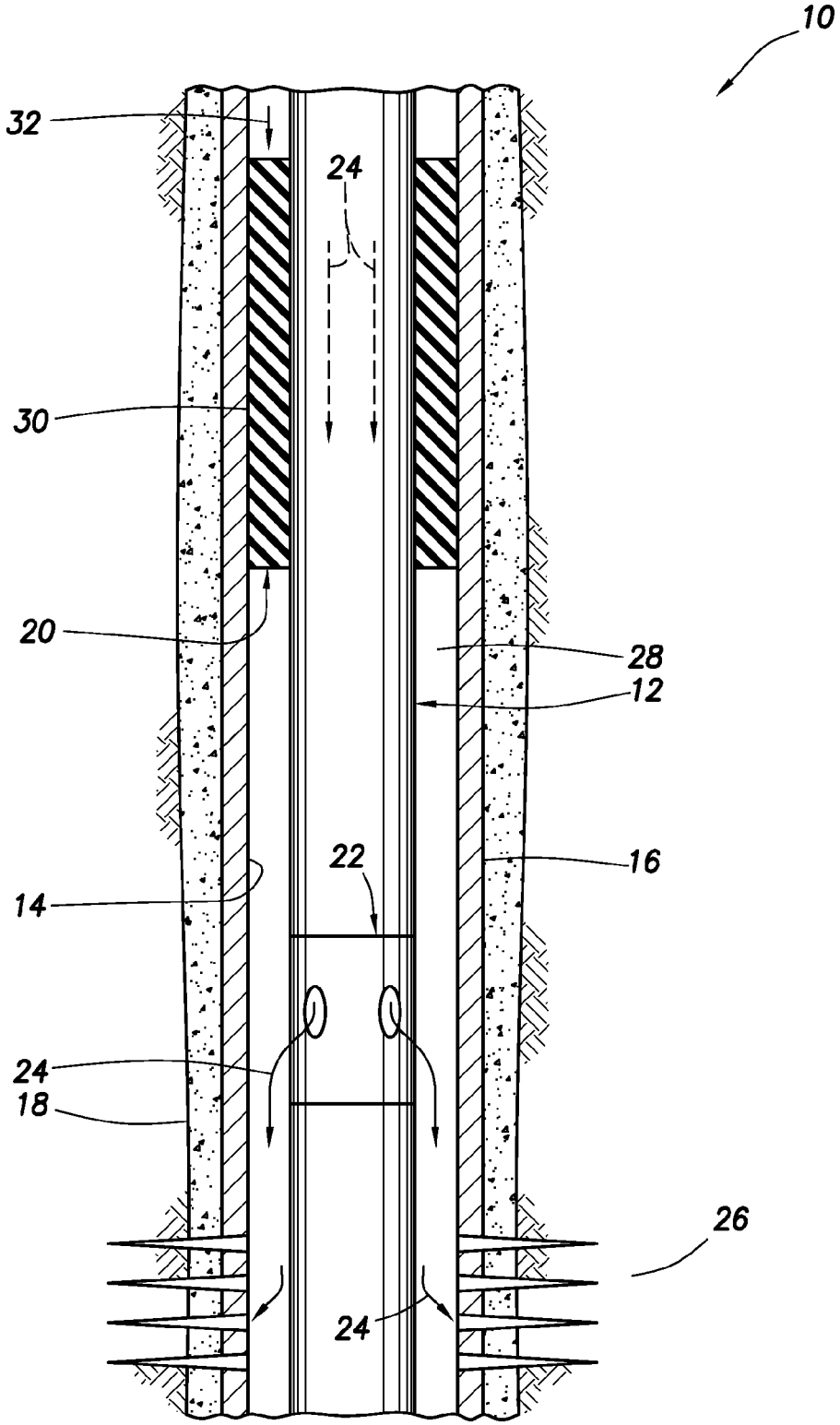
FIG. 1 is a schematic partially cross-sectional view of a well system and associated method which can embody principles of the present disclosure.

Representatively illustrated in FIG. 1 is a well system 10 and associated method which can embody principles of this disclosure. In the well system 10 as shown in FIG. 1, a tubular string 12 is installed in a wellbore 14. In this example, the wellbore 14 is lined with casing 16 and cement 18, but in other examples, portions of the wellbore may be uncased or open hole.

The tubular string 12 includes well tools 20, 22 which are suited for controlling flow of a fluid 24 in a well. In this example, the fluid 24 could be a stimulation fluid (such as a fracturing and/or acidizing fluid, etc.), a treatment fluid (e.g., for treating an earth formation 26 intersected by the wellbore 14, etc.), a completion fluid (such as a gravel packing fluid, etc.), or another type of fluid. In each of these cases, the tubular string 12, including the well tools 20, 22, could be cooled as a result of the flow of the fluid 24 through the tubular string.

The well tool 20 is depicted in FIG. 1 as being of the type known to those skilled in the art as a packer. In this example, the packer is used form an annular barrier, which seals off an annulus 28 formed radially between the tubular string 12 and the wellbore 14.

The packer includes a swellable material which expands in response to contact with a selected swelling fluid in the well, in order to radially outwardly extend a seal element 30. However, if the swellable material contracts when the fluid 24 flows through the tubular string 12, the quality of the sealing engagement between the seal element 30 and the wellbore 14 can be lessened (e.g., the packer may have a decreased annulus differential pressure holding capacity).

The term "swell" and similar terms (such as "swellable") are used herein to indicate an increase in volume of a swellable material. Typically, this increase in volume is due to incorporation of molecular components of an activating agent into the swellable material itself, but other swelling mechanisms or techniques may be used, if desired. Note that swelling is not the same as expanding, although a seal material may expand as a result of swelling.

For example, in some conventional packers, a seal element may be expanded radially outward by longitudinally compressing the seal element, or by inflating the seal element. In each of these cases, the seal element is expanded without any increase in volume of the seal material of which the seal element is made. Thus, in these conventional packers, the seal element expands, but does not swell.

The activating agent which causes swelling of the swellable material is in this example preferably a hydrocarbon fluid (such as oil or gas). In the well system 10, the swellable material swells when the fluid comprises the activating agent (e.g., when the fluid enters the wellbore 14 from the formation 26 surrounding the wellbore, when the fluid is circulated to the well tool 20, when the fluid is released from a chamber carried with the well tool, etc.). In response, the seal element 30 seals off the annulus 28 and applies a gripping force to the wellbore 14.

The activating agent which causes swelling of the swellable material could be comprised in any type of fluid. The activating agent could be naturally present in the well, or it could be conveyed with the well tool 20, conveyed separately or flowed into contact with the swellable material in the well when desired. Any manner of contacting the activating agent with the swellable material may be used in keeping with the principles of this disclosure.

Various swellable materials are known to those skilled in the art, which materials swell when contacted with water and/or hydrocarbon fluid, so a comprehensive list of these materials will not be presented here. Partial lists of swellable materials may be found in U.S. Pat. Nos. 3,385,367 and 7,059,415, and in U.S. Published Application No. 2004-0020662, the entire disclosures of which are incorporated herein by this reference.

As another alternative, the swellable material may have a substantial portion of cavities therein which are compressed or collapsed at the surface condition. Then, after being placed in the well at a higher pressure, the material is expanded by the cavities filling with fluid.

This type of apparatus and method might be used where it is desired to expand the swellable material in the presence of gas rather than oil or water. A suitable swellable material is described in U.S. Published Application No. 2007-0257405, the entire disclosure of which is incorporated herein by this reference.

Preferably, the swellable material used in the well tool 20 swells by diffusion of hydrocarbons into the swellable material, or in the case of a water swellable material, by the water being absorbed by a super-absorbent material (such as cellulose, clay, etc.) and/or through osmotic activity with a salt-like material. Hydrocarbon-, water- and gas-swellable materials may be combined, if desired.

It should, thus, be clearly understood that any swellable material which swells when contacted by a predetermined activating agent may be used in keeping with the principles of this disclosure. The swellable material could also swell in response to contact with any of multiple activating agents. For example, the swellable material could swell when contacted by hydrocarbon fluid, or when contacted by water.

In one important feature of the well tool 20, compensation is provided for a contraction of the swellable material in response to a decrease in temperature of the swellable material. The contraction of the swellable material could follow an increased temperature of the swellable material (due, for example, to installation of the well tool in the well), and could follow swelling of the swellable material in response to contact with a selected fluid 32 in the well.

Note that, although the fluid 24 is depicted in FIG. 1 as flowing downward through the interior of the tubular string 12, in other examples the fluid could flow in other directions, through other flow paths, exterior to the tubular string, etc. In addition, although the fluid 32 is depicted in FIG. 1 as being disposed in the annulus 28, in other examples the fluid 32 could be in the seal element 30, flow from the interior of the tubular string 12, discharge from an interior chamber, etc.

Thus, it should be clearly understood that the principles of this disclosure are not limited at all to any of the details of the well system 10 and method as depicted in FIG. 1 or described herein. Instead, the well system 10 is merely one example of a wide variety of useful applications of the principles of this disclosure.

Swellable materials may be used in well tools other than packers, for example, in actuators of well tools which actuate in response to contact with selected fluid(s). Valves, inflow control devices used with well screens, and other types of well tools could benefit from utilization of the principles of this disclosure.

Figure 2:
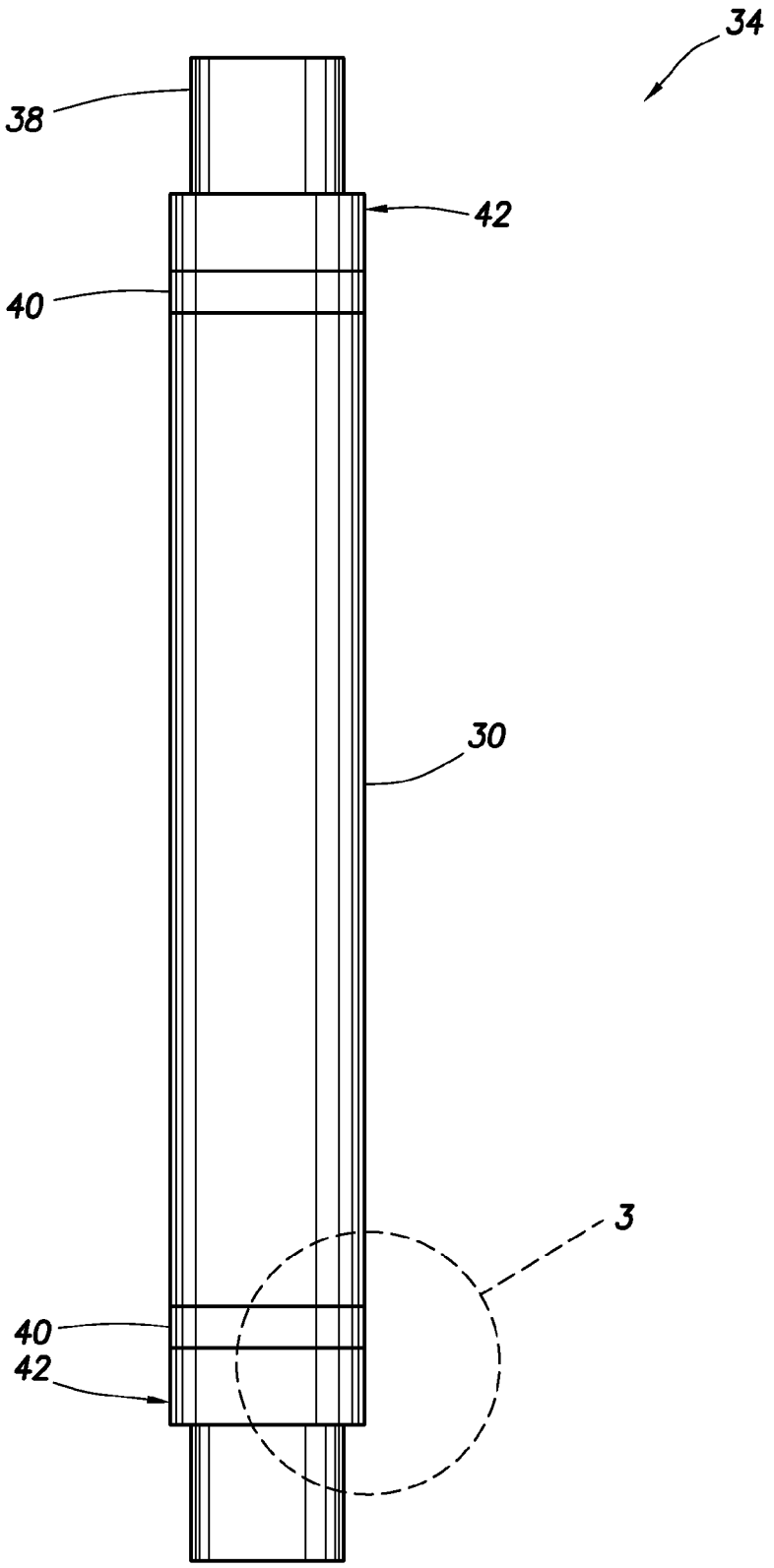
FIG. 2 is an enlarged scale schematic elevational view of a packer which may be used in the well system of FIG. 1.

Referring additionally now to FIG. 2, an example of a packer 34 which may be used for the well tool 20 in the well system 10 and method of FIG. 1 is representatively illustrated. Of course, the packer 34 may be used in other well systems, without departing from the principles of this disclosure.

The packer 34 includes the seal element 30 which extends radially outward in response to contact between a swellable material 36 (see FIG. 3) and the fluid 32 in the well. In addition, the packer 34 includes a generally tubular base pipe or mandrel 38 (which is preferably provided with appropriate end connections for interconnecting in the tubular string 12), anti-extrusion backup rings 40 positioned on opposite longitudinal ends of the seal element 30, and temperature compensators 42 straddling the backup rings and seal element.

The temperature compensators 42 compensate for thermal contraction of the swellable material 36 when temperature decreases, such as, when the fluid 24 is flowed through the tubular string 12. Although two of the temperature compensators 42 are depicted in FIG. 2, any number (including one) of the temperature compensators may be used, as desired.

Figure 3:
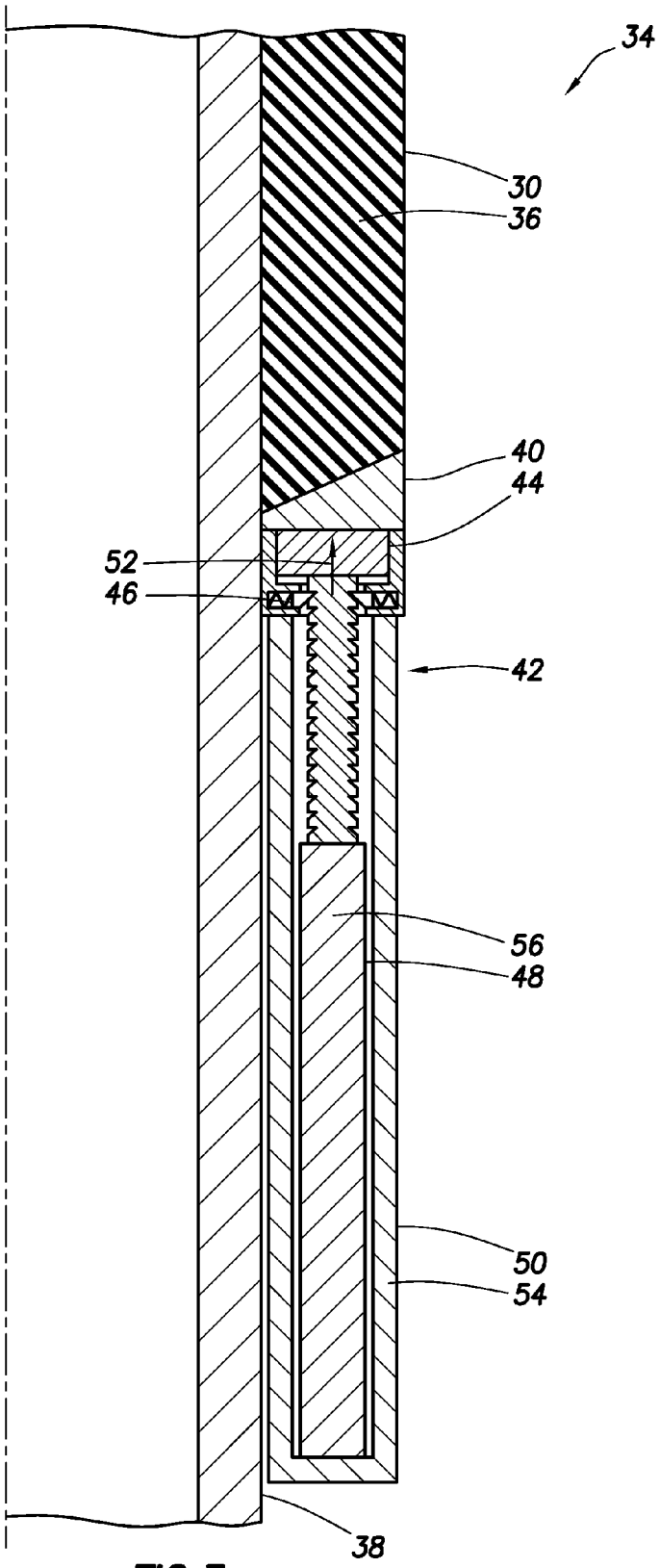
FIG. 3 is a further enlarged scale schematic cross-sectional view of the packer of FIG. 2.

An enlarged cross-sectional view of a portion of the packer 34 is representatively illustrated in FIG. 3. In this view it may be seen that the temperature compensator 42 includes a force transmitting structure 44 which abuts the backup ring 40, a ratchet device 46 which limits displacement of the structure 44, a thermal expansion structure 48 and another thermal expansion structure 50.

The structure 44 is configured to transmit a compressive force 52 from the temperature compensator 42 to the seal element 30 and its swellable material 36 via the backup ring 40. Of course, if the backup ring 40 is not used, the structure 44 could transmit the force 52 directly to the seal element 30, other structures could be used, etc. Thus, it should be appreciated that any type of structure may be used to transmit the force 52 to the seal element 30.

The ratchet device 46 permits displacement of the structure 44 in only one direction (toward the seal element 30). In this manner, the structure 44 will not reverse direction if the temperature increases in the well after the temperature decreases.

The structure 50 in this example includes a positive thermal expansion material 54 which expands in volume in response to an increase in temperature. A suitable material for use as the material 54 is type 316 stainless steel, although other materials may be used, if desired.

The structure 48 in this example includes a negative thermal expansion material 56 which contracts in volume in response to an increase in temperature. Materials showing such negative thermal expansion behavior are typically anisotropic and usually exhibit this behavior over only a small temperature range. However, the zirconium tungstate family of materials is unique in showing strong negative thermal expansion over a broad temperature range.

Other suitable negative thermal expansion materials can include coextruded iron and nickel oxide. SAFENI™, available from Sandvik Materials Technology, is a suitable negative thermal expansion material. Any negative thermal expansion material(s) may be used in the structure 48 in keeping with the principles of this disclosure.

When the temperature decreases, the structure 50 will contract and the structure 48 will elongate, thereby increasingly forcing the structure 44 toward the seal element 30. Compression in the seal element 30 is thereby maintained, eliminating (or at least reducing) any tendency for the seal element to have a decreased sealing capability at reduced temperatures.

Note that it is not necessary for both negative and positive thermal expansion structures 48, 50 to be used in the temperature compensator 42. Only one of these structures could be used, in keeping with the principles of this disclosure.

For example, the temperature compensator 42 could be constructed with a relatively large difference in the thermal expansion characteristics of the structures 48, 50, without either of the structures being made of a negative thermal expansion material. In one example, the outer structure 50 could be made of 316 stainless steel, and the inner structure 48 could be made of a low thermal expansion material, such as NILO™ Alloy 36, available from Special Metals. In response to a temperature decrease, the outer structure 50 would decrease in length, thereby displacing the backup ring 40 toward the seal element 30 and applying increased compressive force 52 to the seal element.

Figure 4:
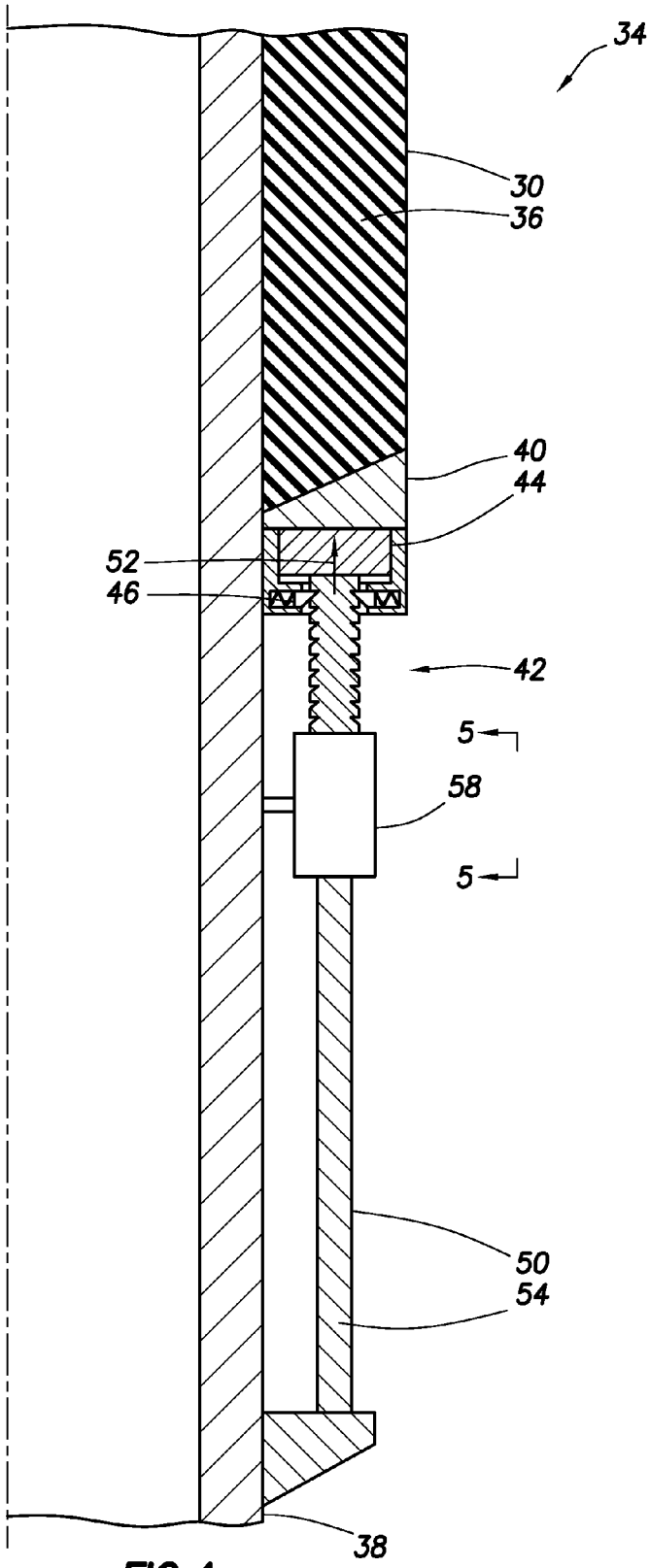
FIG. 4 is a schematic cross-sectional view of another configuration of the packer.

Referring additionally now to FIG. 4, an example is representatively illustrated of a configuration of the packer 34 in which only a positive thermal expansion structure 50 is used. In this configuration, the positive thermal expansion structure 50 is used to rotate a cam 58, thereby displacing the structure 44 toward the seal element 30 and increasing the force 52, in response to decreased temperature.

Figure 5:
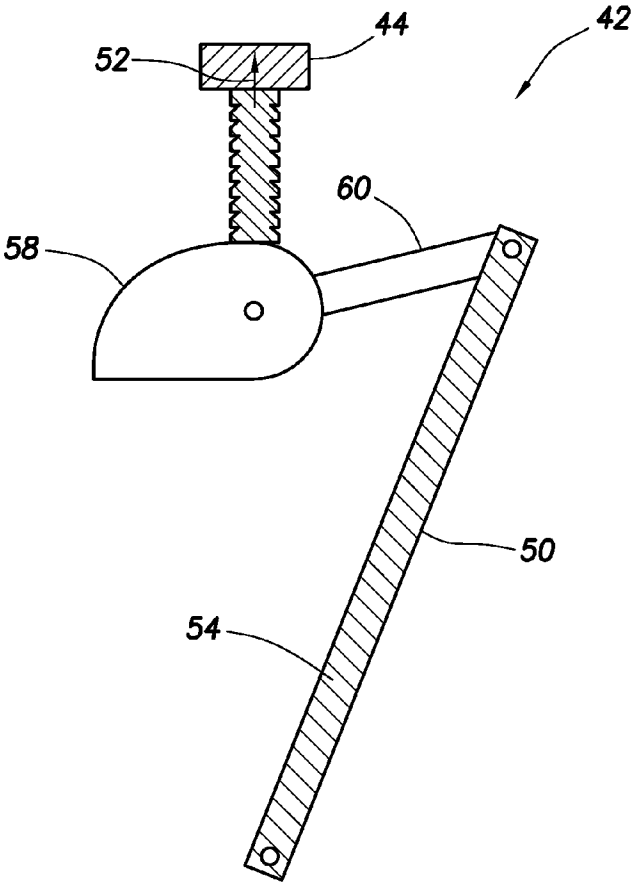
FIG. 5 is a schematic elevational view of a temperature compensator of the FIG. 4 packer configuration.

A side view of the temperature compensator 42 of FIG. 4 is representatively illustrated in FIG. 5. In this example, the positive thermal expansion structure 50 is in the shape of a rod which is connected to the cam 58 via a lever 60.

When the structure 50 contracts as a result of the temperature decrease, the cam 58 is rotated via the lever 60, and the structure 44 is displaced toward the seal element 30. The force 52 applied to the seal element 30 is, thus, increased in response to the temperature decrease.

In other examples, the cam 58 could be replaced by any type of gearing or other mechanical advantage device which can translate a small length change in the structure 50 into a larger displacement of the structure 44.

Figure 6:
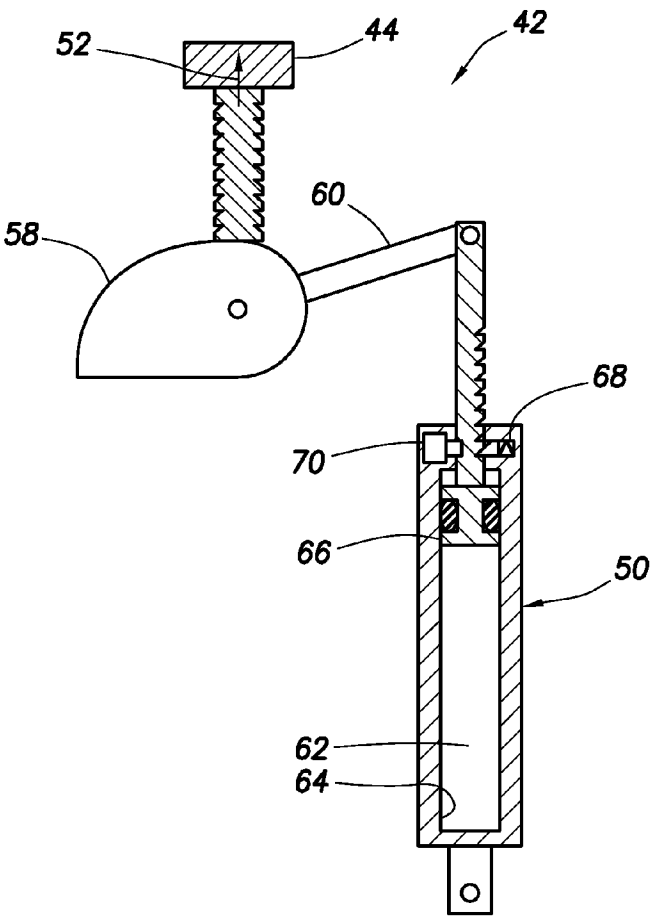
FIG. 6 is a schematic elevational view of another configuration of the temperature compensator.

Another configuration of the temperature compensator 42 is representatively illustrated in FIG. 6. In this configuration, the positive thermal expansion structure 50 includes a gas 62 in a chamber 64.

The volume of the chamber 64 (and the gas 62 therein) decreases in response to a temperature decrease. A piston 66 will displace when there is any change in volume of the chamber 64, thereby rotating the cam 58 via the lever 60.

A ratchet device 68 may be used to permit displacement of the piston 66 in only one direction. In addition, a release device 70 may be used to permit displacement of the piston 66 only when the release device is actuated.

The release device 70 permits the chamber 64 to be charged with the gas 62 at the earth's surface and installed in the well, without producing any inadvertent movement of the piston 66. After installation of the packer 34 in the well, the release device 70 may be actuated to permit displacement of the piston 66.

The release device 70 could be electrically actuated (e.g., an electrical solenoid, etc.) or actuated by swelling of a swellable material, etc. Any type of release device may be used for allowing displacement of the piston 66 in keeping with the principles of this disclosure.

Figure 7:
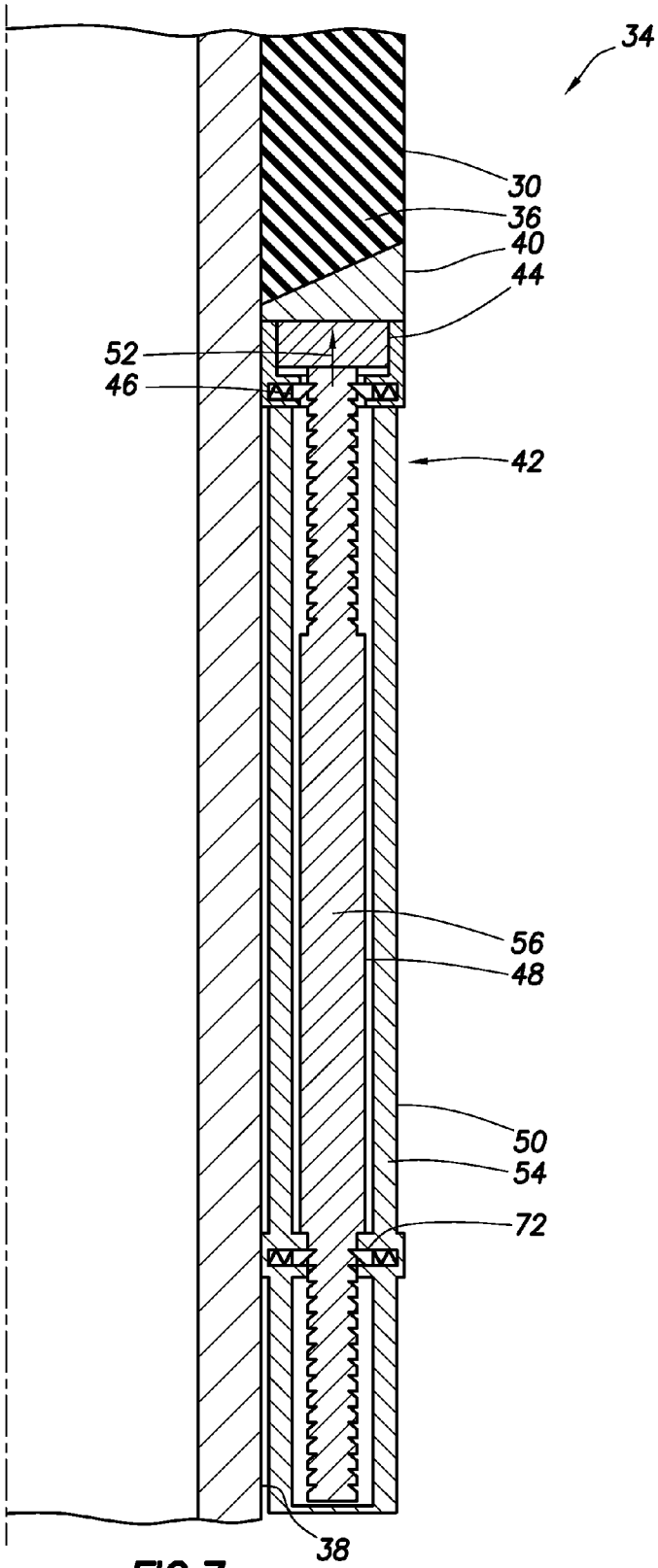
FIG. 7 is a schematic cross-sectional view of another configuration of the packer.

Referring additionally now to FIG. 7, a schematic cross-sectional view of another configuration of the packer 34 is representatively illustrated. This configuration is similar in many respects to the configuration of FIG. 3. However, the FIG. 7 configuration differs at least in that another ratchet device 72 is used to control displacement of the inner structure 48 relative to the outer structure 50.

With each temperature decrease, the structure 48 will displace upward (as viewed in FIG. 7) through the upper ratchet device 46 (downward displacement being prevented by the lower ratchet device 72), thereby increasing the force 52 applied to the seal element 30. With each temperature increase, the structure 48 will displace upward through the lower ratchet device 72 (downward displacement being prevented by the upper ratchet device 46).

Thus, the inner structure 48 will advance upward (as viewed in FIG. 7), toward the seal element 30, applying increased compressive force 52 to the seal element, with each temperature cycle.

Figure 8:
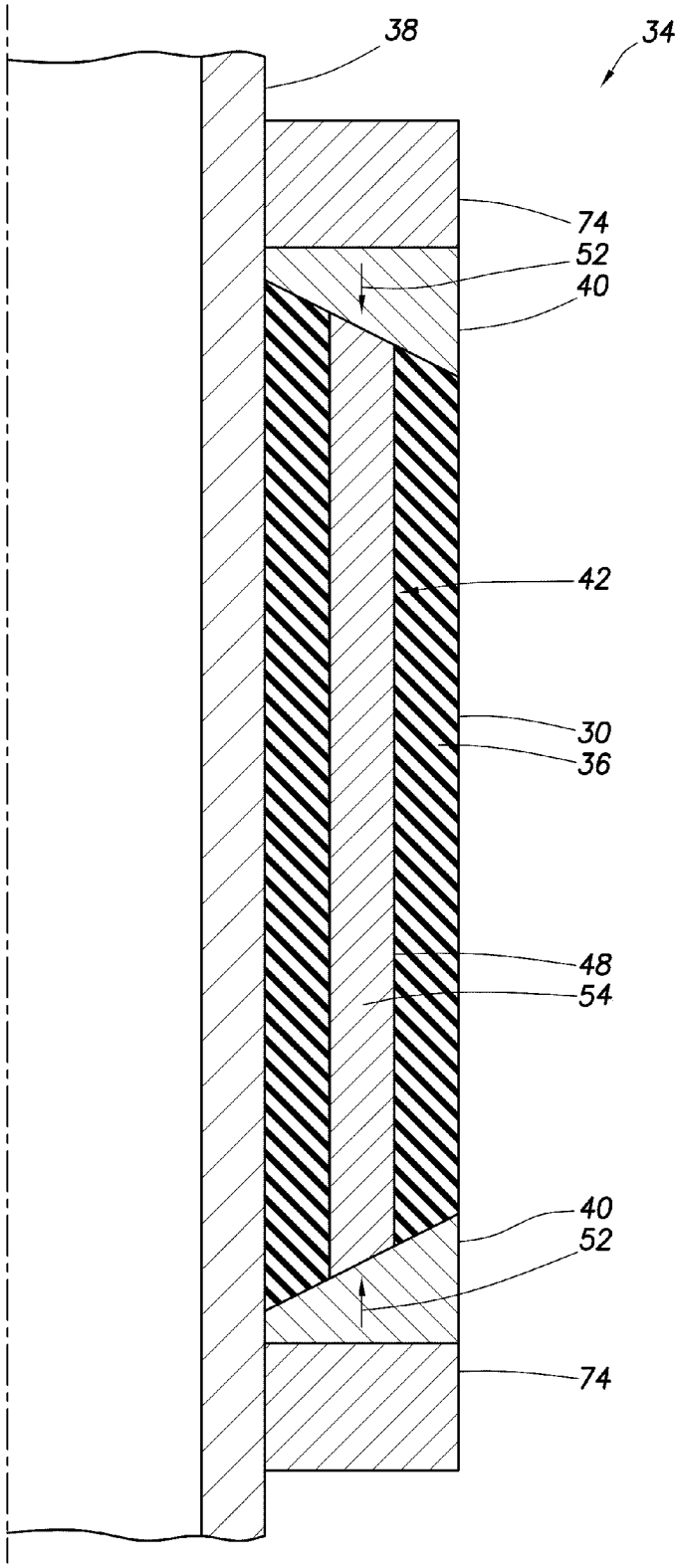
FIG. 8 is a schematic cross-sectional view of another configuration of the packer.

Referring additionally now to FIG. 8, a schematic cross-sectional view of another configuration of the packer 34 is representatively illustrated. In this configuration, multiple circumferentially spaced apart structures 48 extend longitudinally through the seal element 30, and are connected to the backup rings 40 at opposite ends of the seal element. The structures 48 are preferably made with the positive thermal expansion material 54.

One or both of the backup rings 40 are slidably disposed on the mandrel 38. Thus, when the structure 48 contracts in response to a temperature decrease, the distance between the backup rings 40 will decrease, thereby applying increased compressive force 52 to the seal element 30.

The backup rings 40 may be retained on the mandrel 38 by means of end rings 74. Instead of the rod-shaped structures 48, a sleeve-shaped structure could be used, if desired.

It may now be fully appreciated that this disclosure provides to the art a way of compensating for thermal contraction of swellable materials in wells. Several examples are described above of how compressive force can be maintained in a seal element, even though a swellable material which radially outwardly extends the seal element may contract when temperature decreases.

The above disclosure provides to the art a swellable packer 34 for use in a subterranean well. The packer 34 can include a seal element 30 with a swellable material 36 which contracts in response to temperature decrease, and a temperature compensator 42 which applies increased force 52 to the seal element 30 in response to temperature decrease.

The temperature compensator 42 may include a negative thermal expansion material 56.

The temperature compensator 42 may apply increased force 52 to the seal element 30 in response to contraction of a positive thermal expansion material 54. The temperature compensator 42 may apply increased force to the seal element 30 in response to expansion of a negative thermal expansion material 56.

The temperature compensator 42 may apply increased force 52 to the seal element 30 in response to decreased volume of a gas chamber 64.

The swellable material 36 may increase in volume in response to contact with a selected fluid 32 in the well.

Also described by the above disclosure is a method of compensating for thermal contraction of a swellable material 36 in a subterranean well. The method can include a temperature of the swellable material 36 increasing in response to installing the swellable material 36 in the well, and a temperature compensator 42 applying an increased force 52 in response to a temperature decrease occurring after the temperature increasing step.

The method may also include the swellable material 36 swelling in response to exposure to a selected fluid 32 in the well, with the temperature decrease occurring after the swelling step.

The method may also include the swellable material 36 contracting in response to the temperature decrease.

The method may also include flowing a fluid 24 in the well, the temperature decrease occurring in response to the fluid 24 flowing step.

The swellable material 36 may be included in a packer 34 interconnected in a tubular string 12. The fluid 24 flowing step may include flowing the fluid 24 through the packer 34 and tubular string 12.

The above disclosure also describes a well tool 20 for use in a subterranean well, with the well tool 20 comprising a swellable material 36 and a temperature compensator 42 which applies an increased force 52 when the swellable material 36 contracts.

The temperature compensator 42 may include a negative thermal expansion material 56.

The temperature compensator 42 may apply the increased force 52 in response to contraction of a positive thermal expansion material 54.

The temperature compensator 42 may apply the increased force 52 in response to expansion of a negative thermal expansion material 56.

The temperature compensator 42 may apply the increased force 52 in response to decreased volume of a gas chamber 64.

It is to be understood that the various examples described above may be utilized in various orientations, such as inclined, inverted, horizontal, vertical, etc., and in various configurations, without departing from the principles of the present disclosure. The embodiments illustrated in the drawings are depicted and described merely as examples of useful applications of the principles of the disclosure, which are not limited to any specific details of these embodiments.

Of course, a person skilled in the art would, upon a careful consideration of the above description of representative embodiments, readily appreciate that many modifications, additions, substitutions, deletions, and other changes may be made to these specific embodiments, and such changes are within the scope of the principles of the present disclosure. Accordingly, the foregoing detailed description is to be clearly understood as being given by way of illustration and example only, the spirit and scope of the present invention being limited solely by the appended claims and their equivalents.

What is claimed is:

1. A swellable packer for use in a subterranean well, the packer comprising:

a seal element with a swellable material which contracts in response to temperature decrease; and a temperature compensator which applies increased force to the seal element in response to temperature decrease, wherein the temperature compensator includes a negative thermal expansion material.

2. The packer of claim 1, wherein the temperature compensator applies increased force to the seal element in response to contraction of a positive thermal expansion material.

3. The packer of claim 2, wherein the temperature compensator applies increased force to the seal element in response to expansion of the negative thermal expansion material.

4. The packer of claim 1, wherein the swellable material increases in volume in response to contact with a selected fluid in the well.

5. A method of compensating for thermal contraction of a swellable material in a subterranean well, the method comprising:

a temperature of the swellable material increasing in response to installing the swellable material in the well; and a temperature compensator applying an increased force in response to a temperature decrease occurring after the temperature increasing step, wherein the temperature compensator includes a negative thermal expansion material.

6. The method of claim 5, further comprising:

the swellable material swelling in response to exposure to a selected fluid in the well; and wherein the temperature decrease occurs after the swelling step.

7. The method of claim 5, further comprising the swellable material contracting in response to the temperature decrease.

8. The method of claim 5, further comprising flowing a fluid in the well, the temperature decrease occurring in response to the fluid flowing step.

9. The method of claim 8, wherein the swellable material is included in a packer interconnected in a tubular string, and wherein the fluid flowing step further comprises flowing the fluid through the packer and tubular string.

10. The method of claim 5, wherein the temperature compensator applies the increased force in response to contraction of a positive thermal expansion material.

11. The method of claim 10, wherein the temperature compensator applies the increased force in response to expansion of the negative thermal expansion material.

12. A well tool for use in a subterranean well, the well tool comprising:

a swellable material; and a temperature compensator which applies an increased force when the swellable material contracts, wherein the temperature compensator includes a negative thermal expansion material.

13. The well tool of claim 12, wherein the swellable material swells in response to contact with a selected fluid in the well.

14. The well tool of claim 12, wherein the temperature compensator applies the increased force in response to contraction of a positive thermal expansion material.

15. The well tool of claim 14, wherein the temperature compensator applies the increased force in response to expansion of the negative thermal expansion material.

* * * * *